US012584676B2

(12) United States Patent
Cho et al.

(10) Patent No.: US 12,584,676 B2
(45) Date of Patent: Mar. 24, 2026

(54) REFRIGERATOR

(71) Applicant: LG ELECTRONICS INC., Seoul (KR)

(72) Inventors: Yongbum Cho, Seoul (KR); Donghwi Kim, Seoul (KR); Kihwang Kim, Seoul (KR); Wonho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 208 days.

(21) Appl. No.: 18/219,379

(22) Filed: Jul. 7, 2023

(65) Prior Publication Data

US 2024/0035729 A1 Feb. 1, 2024

(30) Foreign Application Priority Data

Jul. 28, 2022 (KR) ..... 10-2022-0093655

(51) Int. Cl.
*F25D 17/08* (2006.01)
*F25D 17/04* (2006.01)

(52) U.S. Cl.
CPC ..... *F25D 17/08* (2013.01); *F25D 17/045* (2013.01)

(58) Field of Classification Search
CPC ..... F25D 17/08; F25D 17/045; F25D 17/047; F25D 21/00; F25D 21/04
See application file for complete search history.

(56) References Cited

FOREIGN PATENT DOCUMENTS

| | | | | | |
|---|---|---|---|---|---|
| EP | 3 764 031 A1 | | 1/2021 | | |
| EP | 3 705 818 B1 | | 4/2022 | | |
| JP | S60-41780 | * | 3/1985 | ..... | F25D 17/08 |
| JP | 2017009220 A | * | 1/2017 | ..... | F25D 17/08 |
| KR | 10-0364991 B1 | | 3/2003 | | |
| KR | 10-2008-0064046 A | | 7/2008 | | |

OTHER PUBLICATIONS

English language machine translation of JP2017009220 to Fukuoka. Translated Mar. 2025 (Year: 2017).*
English language translation of JPS6041780 to Gao. Translated Mar. 2025 (Year: 1985).*

* cited by examiner

*Primary Examiner* — Cassey D Bauer
(74) *Attorney, Agent, or Firm* — Birch, Stewart, Kolasch & Birch, LLP

(57) ABSTRACT

A refrigerator includes a first storage space, a second storage space, a passage duct assembly disposed behind the second storage space and including a cold air passage, a grille fan assembly disposed behind the first storage space and provided with a fan configured to blow cold air, a supply duct assembly configured to supply cold air blown from the grille fan assembly to the passage duct assembly, and a passage opening/closing module configured to selectively block the cold air supplied to the supply duct assembly. The passage opening/closing module includes a damper having a damper through-hole and a damper door configured to open and close the damper through-hole, and a damper cover configured to surround at least a portion of the damper. The damper cover includes an anti-freezing passage through which a portion of the cold air blown from the grille fan assembly is discharged to the supply duct assembly.

21 Claims, 16 Drawing Sheets

(a)

(b)

REFRIGERATOR

CROSS-REFERENCE TO RELATED APPLICATIONS

The present application claims priority under 35 U.S.C. 119 to Korean Patent Application No. 10-2022-0093655, filed in the Republic of Korea on Jul. 28, 2022, which is hereby incorporated by reference in its entirety.

BACKGROUND

The present disclosure relates to a refrigerator.

A refrigerator is a home appliance that supplies cold air generated by circulation of a refrigerant to a storage compartment such as a refrigerating compartment and a freezing compartment so that various types of storage objects are stored to be fresh for a long time in the storage compartment.

In order to increase in internal volume of the refrigerating compartment, cold air may be supplied to both the refrigerating compartment and the freezing compartment through a single evaporator disposed in the freezing compartment. The cold air generated by the evaporator may be blown into the freezing compartment and the refrigerating compartment by the grille fan assembly and may be supplied to the refrigerating compartment through a supply duct assembly allowing the refrigerating compartment and the freezing compartment to communicate with each other.

In this case, since the cold air has to be supplied to the refrigerating compartment and the freezing compartment, which require different temperatures and amounts of cold air, through one evaporator and grille fan assembly, a passage opening/closing damper that is capable of selectively blocking the cold air supplied into the refrigerating compartment may be additionally disposed.

When the cold air is supplied to the refrigerating compartment, the passage opening/closing damper may be opened to supply the cold air to the refrigerating compartment through the supply duct assembly. In addition, when sufficient cold air is supplied to satisfy the temperature required by the refrigerating compartment, a passage opening/closing damper is closed to block a cold air passage extending from the freezing compartment to the refrigerating compartment.

However, when the passage opening/closing damper is blocked as described above, wet air, which is cold air in the refrigerating compartment having a relatively high-temperature and high-humidity, may be naturally caused to flow backward into an empty space of the cold air passage.

For example, the wet air may flow backward into the supply duct assembly, in which the supply of the cold air is blocked by the passage opening/closing damper, and then may adhere to the cold air passage of the supply duct assembly that is relatively cold to cause freezing.

If the ice is formed in the cold air passage of the supply duct assembly, the flow of the cold air in the cold air passage may be hindered, and the damper door of the passage opening/closing damper may be frozen and thus may not be properly opened, making it difficult to supply the cold air to the refrigerating compartment.

Korean Patent Registration No. 10-0364991 discloses a refrigerator which includes a heater that generates heat for a set time to prevent a damper from being frozen when closing of a door of a refrigerating compartment is detected so as to prevent the damper from being frozen.

However, although the freezing is reduced using the heat in the related art, there is a limitation in that a large amount of power has to be consumed to remove the ice.

SUMMARY

Embodiments provide a refrigerator including a passage duct assembly having a cold air passage of a supply duct assembly that supplies cold air to a passage duct assembly and a cold air passage, which is capable of reducing freezing of a passage opening/closing damper.

Embodiments also provide a refrigerator including a supply duct assembly having a novel structure capable of reducing freezing of a cold air passage and a passage opening/closing damper of a supply duct assembly.

In one embodiment, a refrigerator includes an anti-freezing passage through which a portion of cold air blown from a grille fan assembly is discharged to a supply duct assembly in a state in which a damper through-hole is closed by a damper door.

In one embodiment, a refrigerator includes: a first storage space; a second storage space disposed at one side of the first storage space; a passage duct assembly disposed behind the second storage space and comprising a cold air passage; a grille fan assembly disposed behind the first storage space and provided with a fan module configured to blow cold air; a supply duct assembly configured to supply cold air blown from the grille fan assembly to the passage duct assembly; and a passage opening/closing module configured to selectively block the cold air supplied to the supply duct assembly, wherein the passage opening/closing module includes: a damper provided with a damper through-hole through which the cold air passes and a damper door configured to open and close the damper through-hole; and a damper cover configured to surround at least a portion of the damper, wherein, in the damper cover, in a state in which the damper through-hole is closed by the damper door, an anti-freezing passage through which a portion of the cold air blown from the grille fan assembly is discharged to the supply duct assembly.

The anti-freezing passage may be disposed in an upper end of the damper cover with respect to a vertical direction of the damper cover.

The anti-freezing passage may be disposed at a position corresponding to a position at which the fan module is mounted.

The damper cover may include a first cover portion in which at least a portion of the damper is accommodated, and the anti-freezing passage may be recessed inward from the first cover portion and disposed to be spaced a set interval from the damper.

The anti-freezing passage may have one end disposed at a central portion of the first cover portion and the other end disposed on one end of the first cover portion.

The anti-freezing passage may include an inclined portion that is inclined downward toward the one end of the first cover portion.

The damper cover may further include a first damper cover and a second damper cover, which are configured to surround one side and the other side of the damper, respectively, the damper door may be opened in a direction in which the first damper cover is disposed, and the anti-freezing passage may be disposed in the first damper cover.

The first damper cover may include: a first cover portion in which at least a portion of the damper is accommodated; a second cover portion configured to define a top surface of the first damper cover; and a cover edge portion configured to protrude from one side of the first cover portion in a direction in which the damper is provided.

A damper operation motor that operates to open and close the damper door may be disposed to be in contact with the second cover portion, and the anti-freezing passage may be disposed to be spaced a set interval downward from an upper end of the first cover portion.

The anti-freezing passage may have one end disposed at a central portion of the first cover portion and extends up to the cover edge portion.

The anti-freezing passage may include: a first anti-freezing passage recessed from the first cover portion; and a second anti-freezing passage extending from one end of the first cover portion in the direction in which the damper is provided.

The second anti-freezing passage may be disposed between an upper end of the cover edge portion and a lower end of the second cover portion.

A flow rate of the cold air discharged from the anti-freezing passage may be less than about 1%, based on about 100% of a flow rate of the cold air discharged by the fan module.

The anti-freezing passage may extend in a direction crossing a direction in which the damper through-hole extends.

The anti-freezing may have an area that gradually decreases toward one end of the damper cover.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Figure 1:
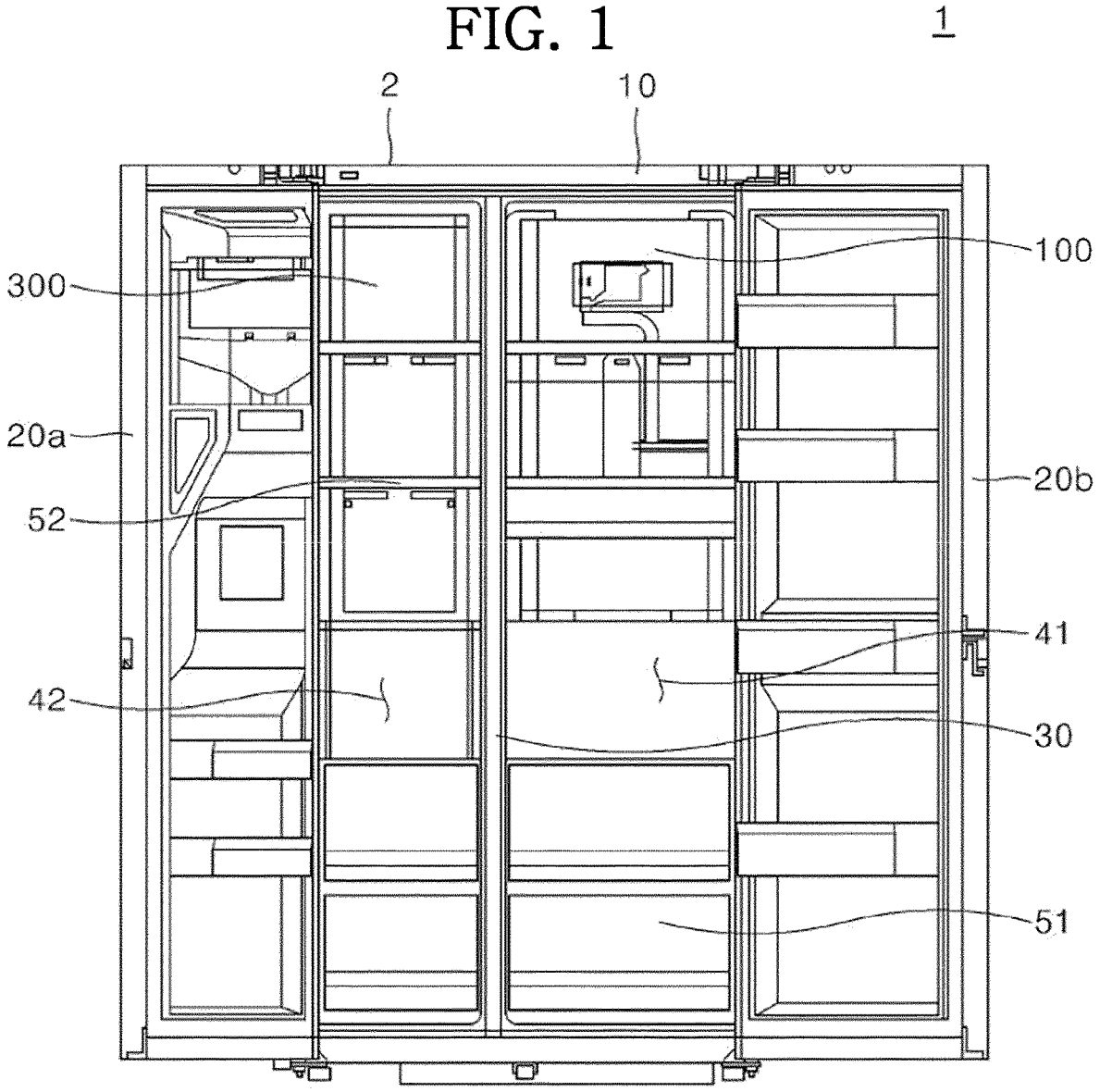
FIG. 1 is a front view of a side-by-side refrigerator in a state in which a door is opened.

FIG. 1 is a front view of a side-by-side refrigerator in a state in which a door is opened.

An outer appearance of a refrigerator 1 may be defined by a cabinet 2 defining a storage space and a door that is capable of opening and closing an opened front surface of the cabinet 2.

The cabinet 2 may include an outer case 10 defining an outer surface of the refrigerator 1 and an inner case 30 defining an inner surface of the refrigerator 1.

The outer case 10 and the inner case 30 may be provided to have a space spaced apart from each other, and an insulating material may be foamed into the spaced space so as to be filled in the empty space.

The inner case 30 may be partitioned into a plurality of opened box-shaped spaces and may be divided into a refrigerating compartment 41 and a freezing compartment 42.

In an embodiment, a side-by-side refrigerator in which the refrigerating compartment 41 and the freezing compartment 42 are arranged side by side will be described as an example.

A door may be connected to the front surface of the cabinet 2 to open and close the refrigerator 1.

A first door 20*a* may be disposed on a front surface corresponding to the freezing compartment 42, and a second door 20*b* may be disposed on a front surface corresponding to the refrigerating compartment 41.

For example, the first door 20*a* and the second door 20*b* may have rotational axes at both sides of the cabinet 2 to rotate.

The refrigerating compartment 41 and the freezing compartment 42 may be provided with a plurality of accommodation portions 51 and a plurality of shelf portions 52, which move to be drawn out or drawn in a sliding manner along rails so that objects to be stored are easily accommodated and stored.

A separate temperature sensor may be provided in each of the refrigerating compartment 41 and the freezing compartment 42 so that the refrigerating compartment 41 and the freezing compartment 42 are independently adjusted to be maintained at different temperatures.

Here, the freezing compartment 42 may also be referred to as a first storage space. In addition, the refrigerating compartment 41 may be referred to as a second storage space.

Hereinafter, a coupling relationship between the passage duct assembly, the supply duct assembly, and the grille fan assembly will be described.

Figure 2:
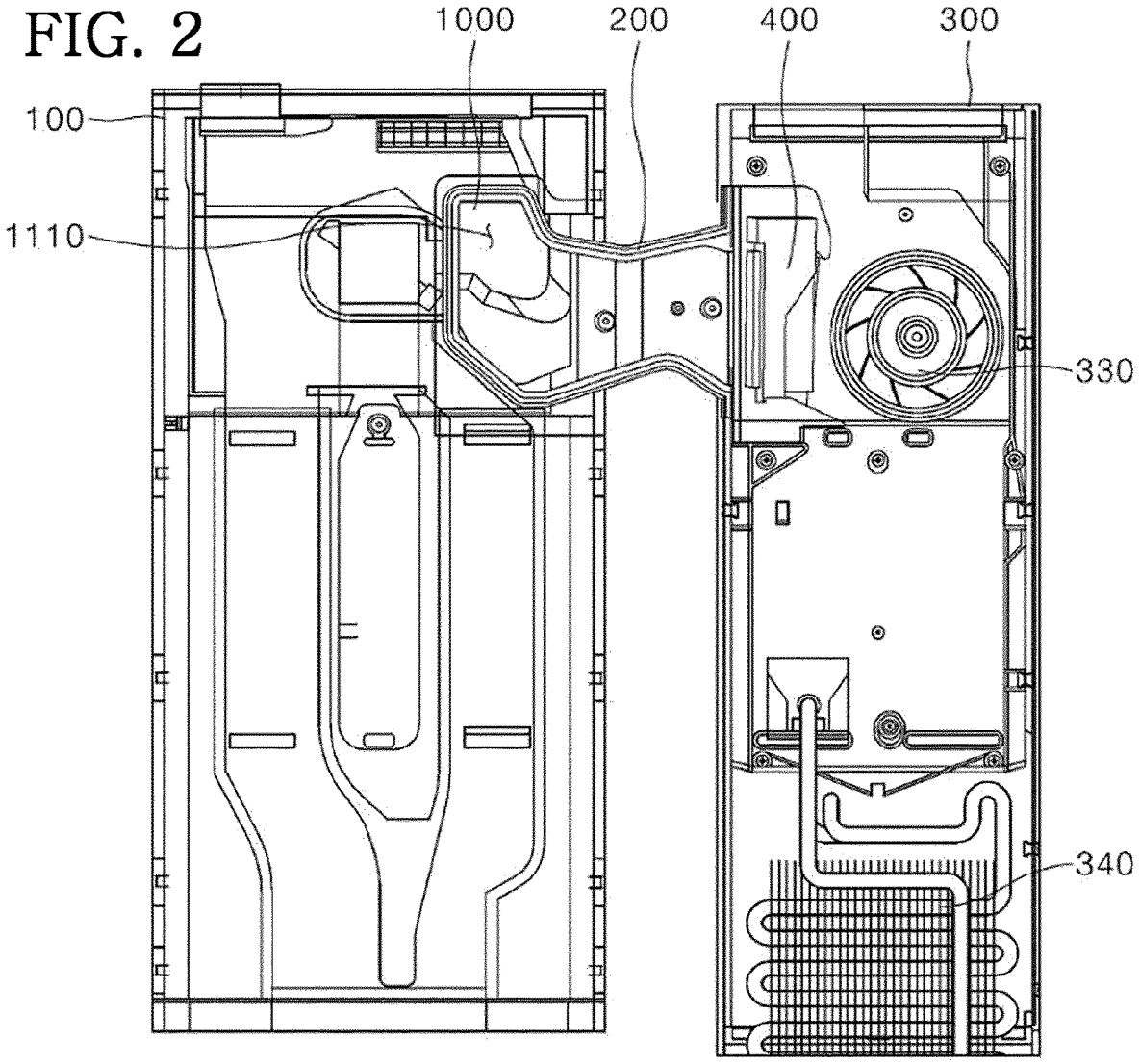
FIG. 2 is a rear view illustrating a state in which a passage duct assembly, a supply duct assembly, and a grille fan assembly are coupled to each other according to an embodiment.

FIG. 2 is a rear view illustrating a state in which the passage duct assembly, the supply duct assembly, and the grille fan assembly are coupled to each other according to an embodiment.

The refrigerating compartment 41 may be disposed at one side of the freezing compartment 42, and the refrigerating compartment 41 and the freezing compartment 42 may be disposed side by side with each other.

The passage duct assembly 100 including the cold air passage 1000 through which the cold air flows may be disposed at a rear side of the refrigerating compartment 41.

The passage duct assembly 100 may include a passage duct cold air inlet 1110 having a shape recessed so that a rear side thereof is exposed.

The cold air introduced into the passage duct cold air inlet 1110 may flow within the passage duct assembly 100 through the cold air passage 1000.

The passage duct cold air inlet 1110 is disposed in a relatively upper region with respect to a central area of the passage duct assembly 100 and may be disposed close to the other surface.

The grille fan assembly 300 may be disposed at the rear side of the freezing compartment 42. The grille fan assembly 300 may be disposed at the rear side of the freezing compartment 42.

The grille fan assembly 300 may include an evaporator 340 that generates the cold air and a fan module 330 that blows the cold air generated from the evaporator 340.

For example, the evaporator 340 may be disposed in a relatively lower region with respect to the central area of the grille fan assembly 300, and the fan module 330 may be disposed in an upper region, but are not limited thereto.

The cold air blown by the fan module 330 may be supplied to the freezing compartment 42 and the refrigerating compartment 41.

The supply duct assembly 200 may be disposed between the other surface of the passage duct assembly 100 and one surface of the grille fan assembly 300. The supply duct assembly 200 may have one side communicating with the passage duct assembly 100 and the other side communicating with the grille fan assembly 300.

Thus, the cold air blown by the fan module 330 of the grille fan assembly 300 may be supplied to the passage duct assembly 100 through the supply duct assembly 200.

The grille fan assembly 300 may include a passage opening/closing module 400 that selectively blocks the cold air supplied to the supply duct assembly 200.

The passage opening/closing module 400 may be disposed to communicate with the other side of the supply duct assembly 200 at the rear side of the freezing compartment 42, thereby adjusting an amount of cold air supplied to the refrigerating compartment 41 via the supply duct assembly 200 through an opening/closing operation of the passage opening/closing module 400.

Hereinafter, the passage duct assembly 100 according to an embodiment will be described in detail.

Figure 3:
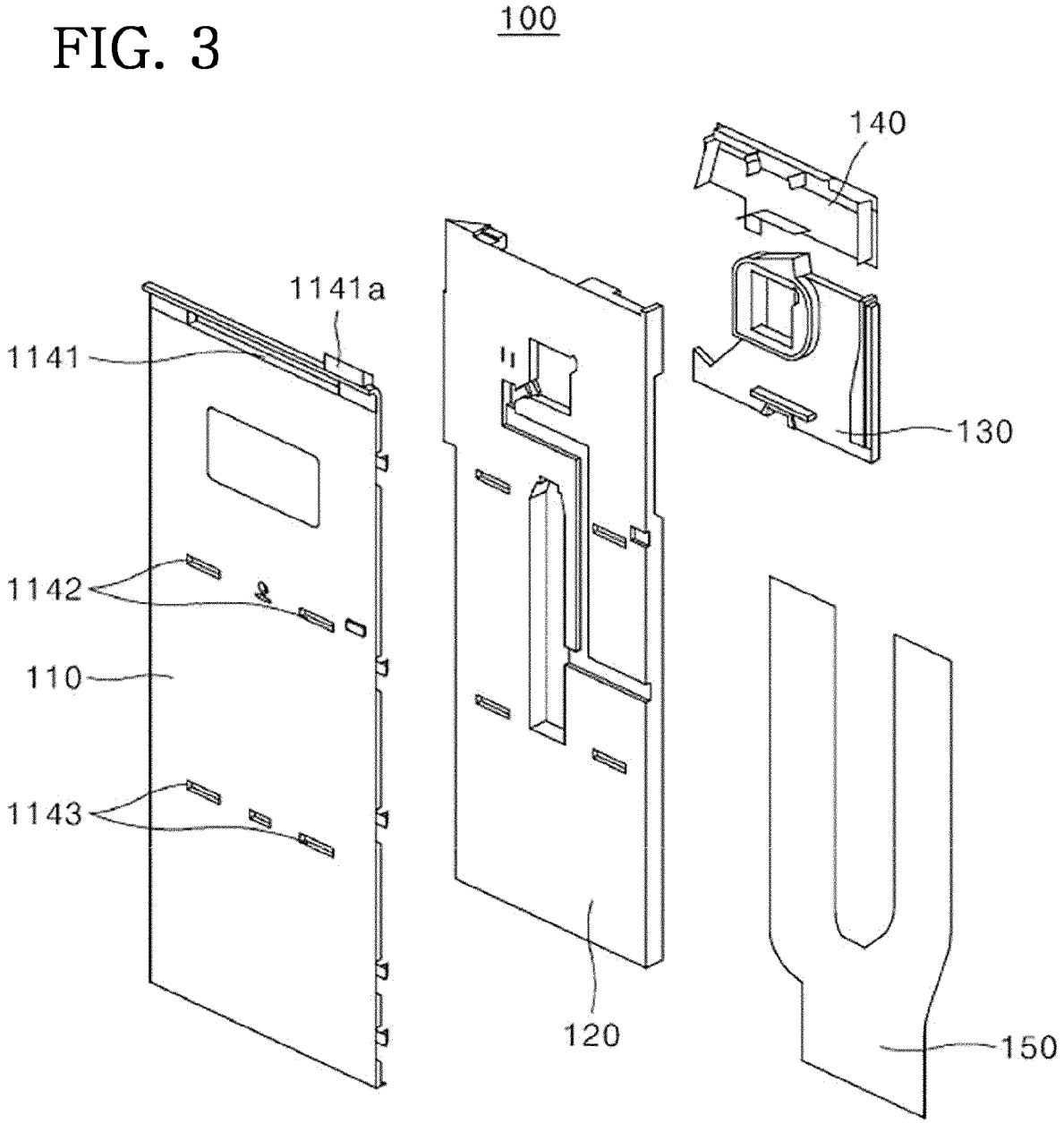
FIG. 3 is an exploded perspective view of the passage duct assembly in a forward direction.
Figure 4:
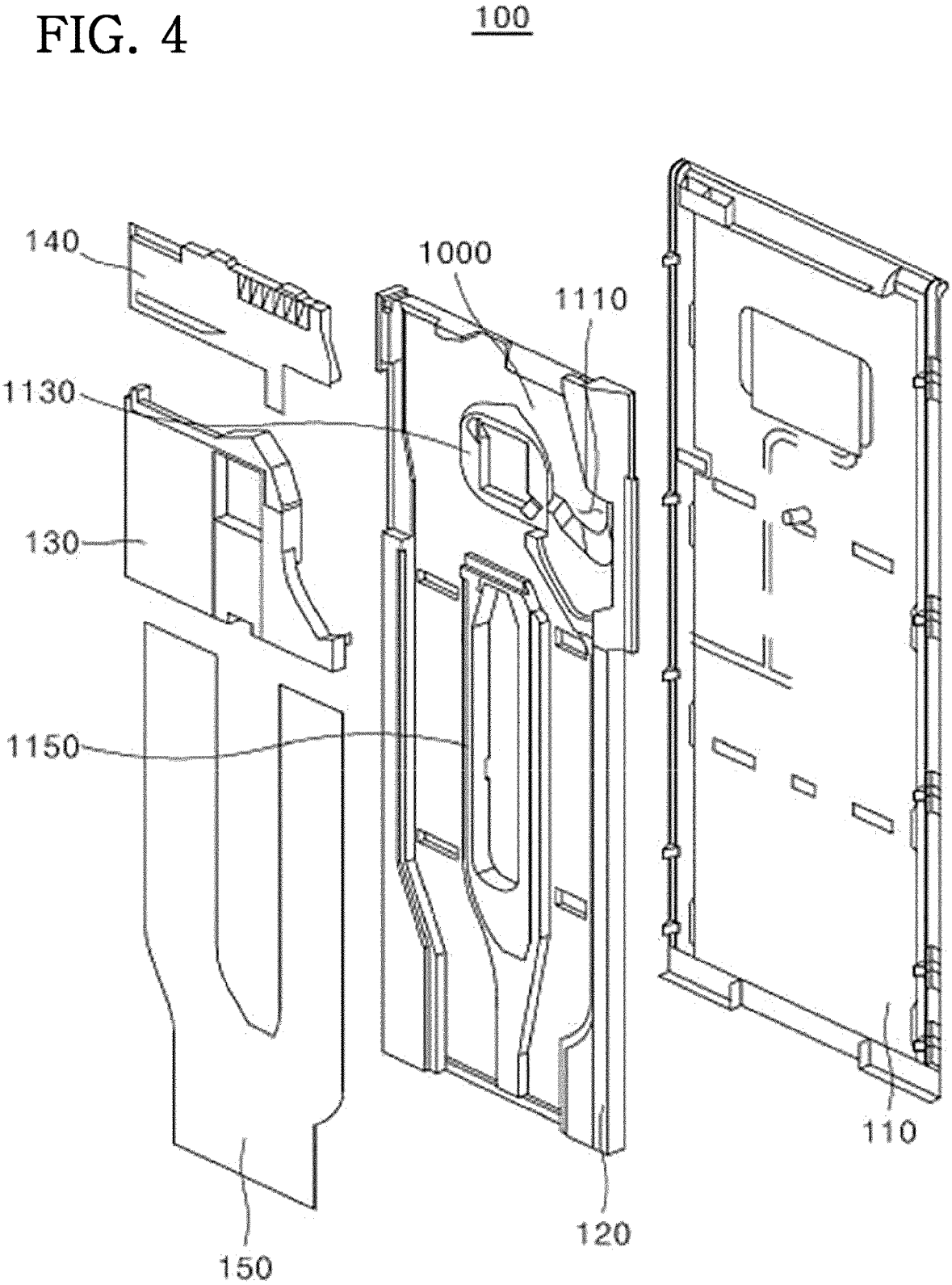
FIG. 4 is an exploded perspective view of the passage duct assembly in a backward direction.

FIG. 3 is an exploded perspective view of the passage duct assembly in a forward direction. In addition, FIG. 4 is an exploded perspective view of the passage duct assembly in a backward direction.

The passage duct assembly 100 may include a passage duct body 110, a first passage duct insulating portion 120, a second passage duct insulating portion 130, a first passage duct cover 140, and a second passage duct cover 150.

The passage duct body 110 may include a cold air outlet through which the cold air flowing through the cold air passage 1000 of the passage duct assembly 100 is discharged into the refrigerating compartment 41.

For example, the first cold air outlet 1141 may be provided in an upper region of the passage duct body 110 to face the front surface of the refrigerating compartment 41.

A first auxiliary cold air outlet 1141*a* may be provided in the upper region of the passage duct body 110 to face an upward side.

A plurality of second cold air outlets 1142 may be provided in the central region of the passage duct body 110, and a plurality of third cold air outlets 1143 may be provided in the lower region to uniformly supply the cold air over the entire region of the refrigerating compartment 41.

The passage duct body 110 may fix a temperature sensor, an antibacterial filter, a lighting, and the like and may be visually recognized by a user from the front surface of the refrigerating compartment 41.

The first passage duct insulating portion 120 may be disposed on a rear surface of the passage duct body 110. The first passage duct insulating portion 120 may be one component that provides the passage 1000 of the cold air flowing inside the passage duct assembly 100.

The first passage duct insulating portion 120 may be made of an insulating material such as Styrofoam so as to reduce an influence of the refrigerating compartment 41 by the cold air flowing through the cold air passage 1000.

The passage duct cold air inlet 1110 into which the cold air is introduced may be recessed from the other side of the upper region of the first passage duct insulating portion 120 to communicate with the cold air passage 1000.

Since the passage duct cold air inlet 1110 is opened upward and closed downward, the cold air passage 1000 starting from the passage duct cold air inlet 1110 may communicates upward.

An island-shaped first cold air guide portion 1130 may be disposed to be in contact with one side of the passage duct cold air inlet 1110.

An island-shaped second cold air guide portion 1150 may be disposed below the first cold air guide portion 1130. A pair of cold air passages 1000 through which the cold air is branched to flow may be provided at both sides of the second cold air guide portion 1150, respectively.

Each of the first cold air guide portion 1130 and the second cold air guide portion 1150 may have a predetermined thickness and protrude backward to provide the cold air passage 1000.

The second passage duct insulating portion 130 may be coupled to the rear surface of the first passage duct insulating portion 120 to provide and seal the cold air passage 1000.

Like the first passage duct insulating portion 120, the second passage duct insulating portion 130 may be made of an insulating material such as Styrofoam having a predetermined thickness.

The first passage duct cover 140 may be disposed above the second passage duct insulating portion 130 to guide the cold air to the first cold air outlet 1141 and the first auxiliary cold air outlet 1141*a* and seal the cold air passage 1000.

In addition, the second passage duct cover 150 having a shape corresponding to the cold air passage 1000 at each of both sides of the second cold air guide portion 1150 may be disposed below the second passage duct insulating portion 130 to seal the cold air passage 1000 disposed in each of the center region and the lower region.

The passage duct cold air inlet 1110 may be provided at the other side of the upper region of the passage duct assembly 100, and an area corresponding to the passage duct cold air inlet 1110 may be defined as an opening area exposed backward.

Since the passage duct cold air inlet 1110 communicates with the cold air passage 1000, a portion of the cold air passage 1000 exposed by the passage duct cold air inlet 1110 may also be exposed to the outside.

In this case, the cold air passage 1000 exposed by the passage duct cold air inlet 1110 may be opened to an upper side of the passage duct assembly 100 and closed to a lower side of the passage duct assembly 100. Thus, the cold air introduced into the passage duct cold air inlet 1110 may not flow downward, but flow upward.

In addition, since the cold air passage 1000 exposed by the passage duct cold air inlet 1110 is closed downward, a cold air sagging phenomenon may be prevented from occurring.

For example, when the cold air continuously flows into the passage duct cold air inlet 1110, the flow of the cold air flowing upward may prevent wet air of the refrigerating compartment 41 from flowing backward through the first cold air outlet 1141.

When the inflow of the cold air into the passage duct cold air inlet 1110 is blocked, the flow of the cold air flowing upward is cut off, since the flow of the cold air flowing upward is cut off, the wet air in the refrigerating compartment 41 may flow backward through the first cold air outlet 1141 by natural convection.

In this case, if the cold air passage 1000 exposed by the passage duct cold air inlet 1110 is also opened downward, the cold air sagging phenomenon in which the cold air is discharged downward may occur. When the cold air sagging phenomenon occurs, the wet air may be introduced into the empty space of the passage duct cold air inlet 1110, which is caused by the cold air sagging, and the wet air that flows backward may adhere to the supply duct assembly 200 and the passage opening/closing module 400, which communicate with the passage duct cold air inlet 1110 to cause freezing.

However, according to an embodiment, since the cold air passage 1000 exposed by the passage duct cold air inlet 1110 of the passage duct assembly 100 is opened upward and closed downward, the sagging of the cold air in the downward direction may be prevented from occurring to reduce the inflow of the wet air into the empty space that may occur due to the sagging of the cold air.

Hereinafter, the grille fan assembly 300 and the passage opening/closing module 400 according to an embodiment will be described in detail.

Figure 5:
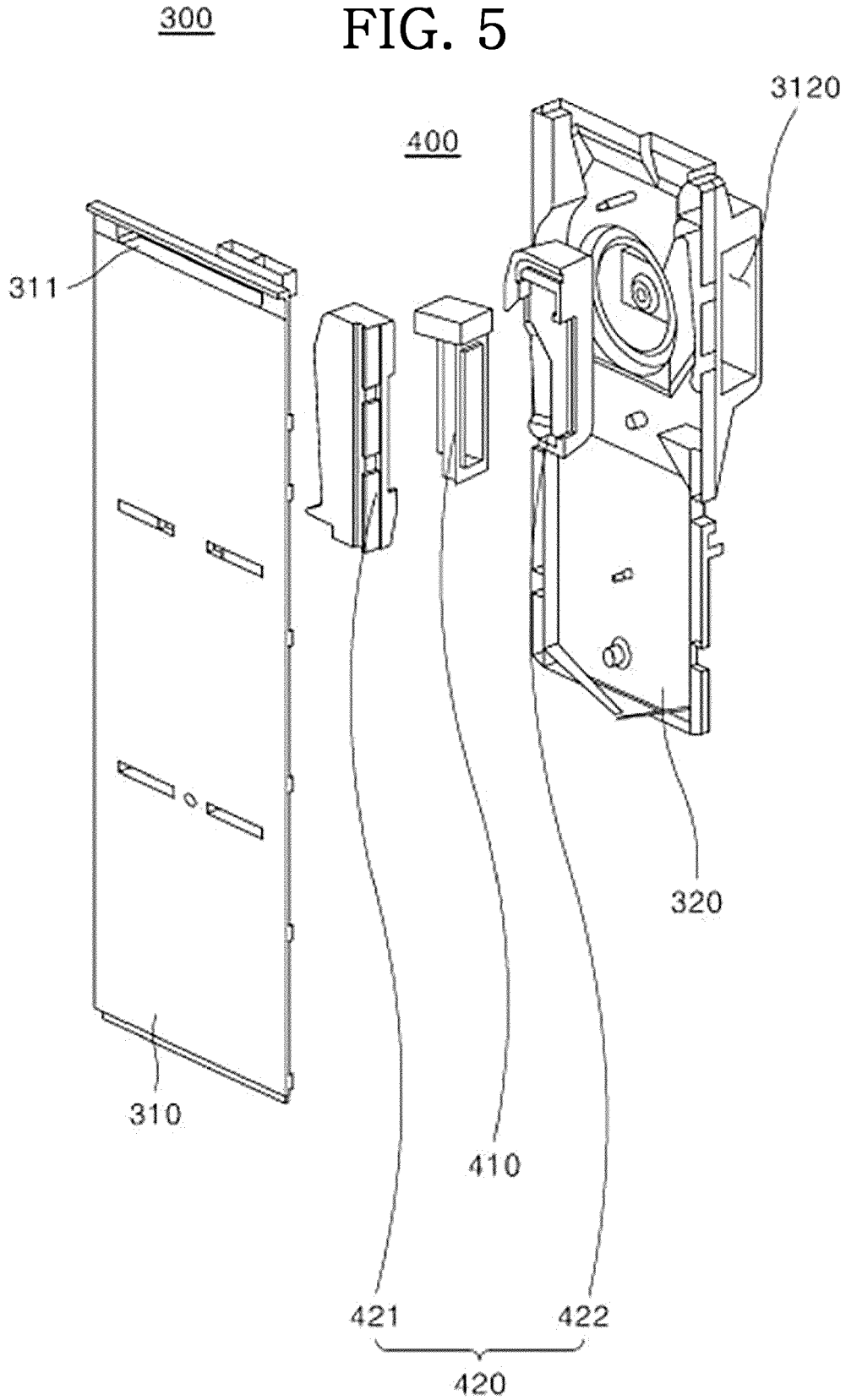
FIG. 5 is an exploded perspective view of the grille fan assembly.
Figure 6:
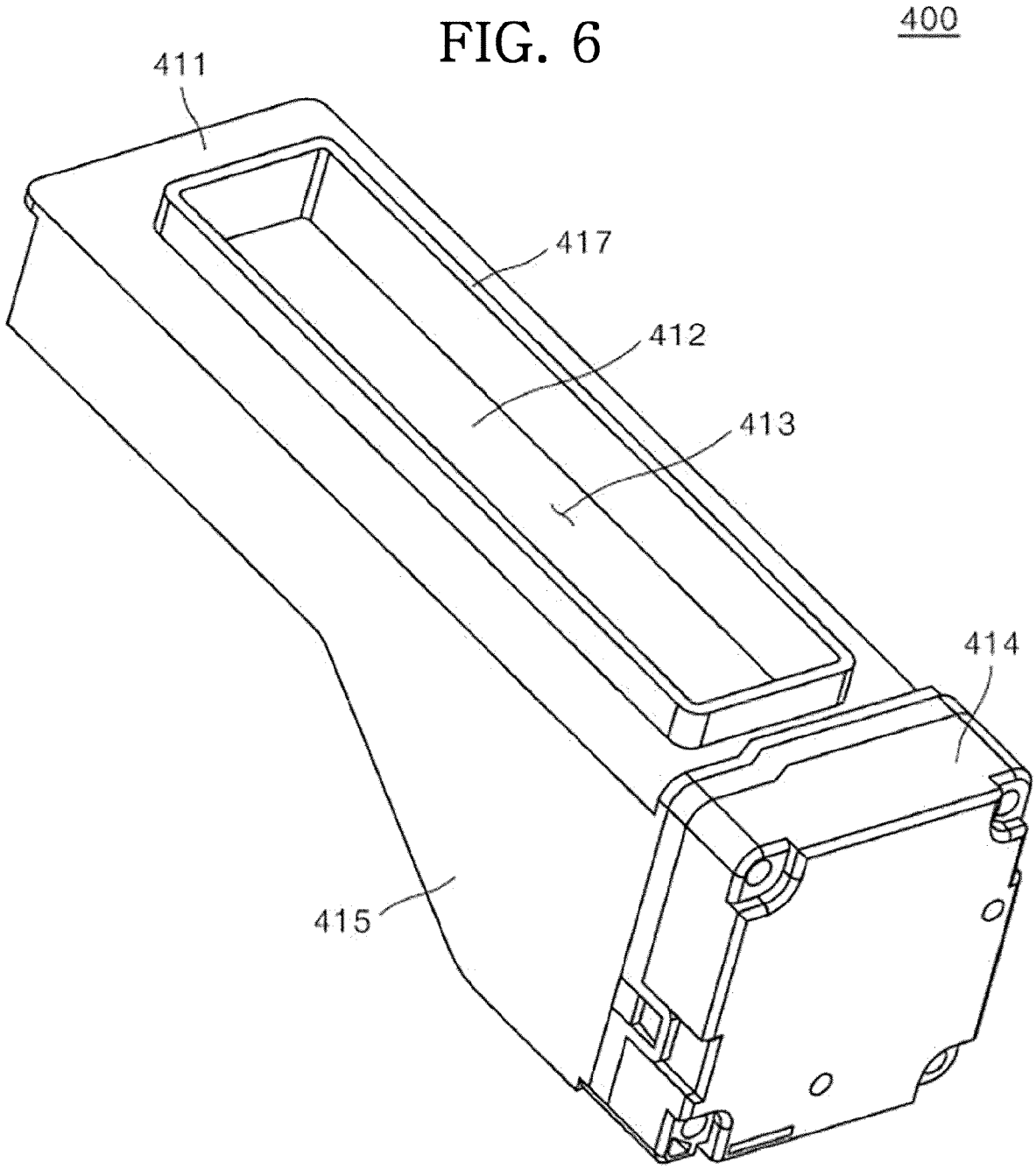
FIG. 6 is a perspective view illustrating a state in which a damper door of a damper is closed.
Figure 7:
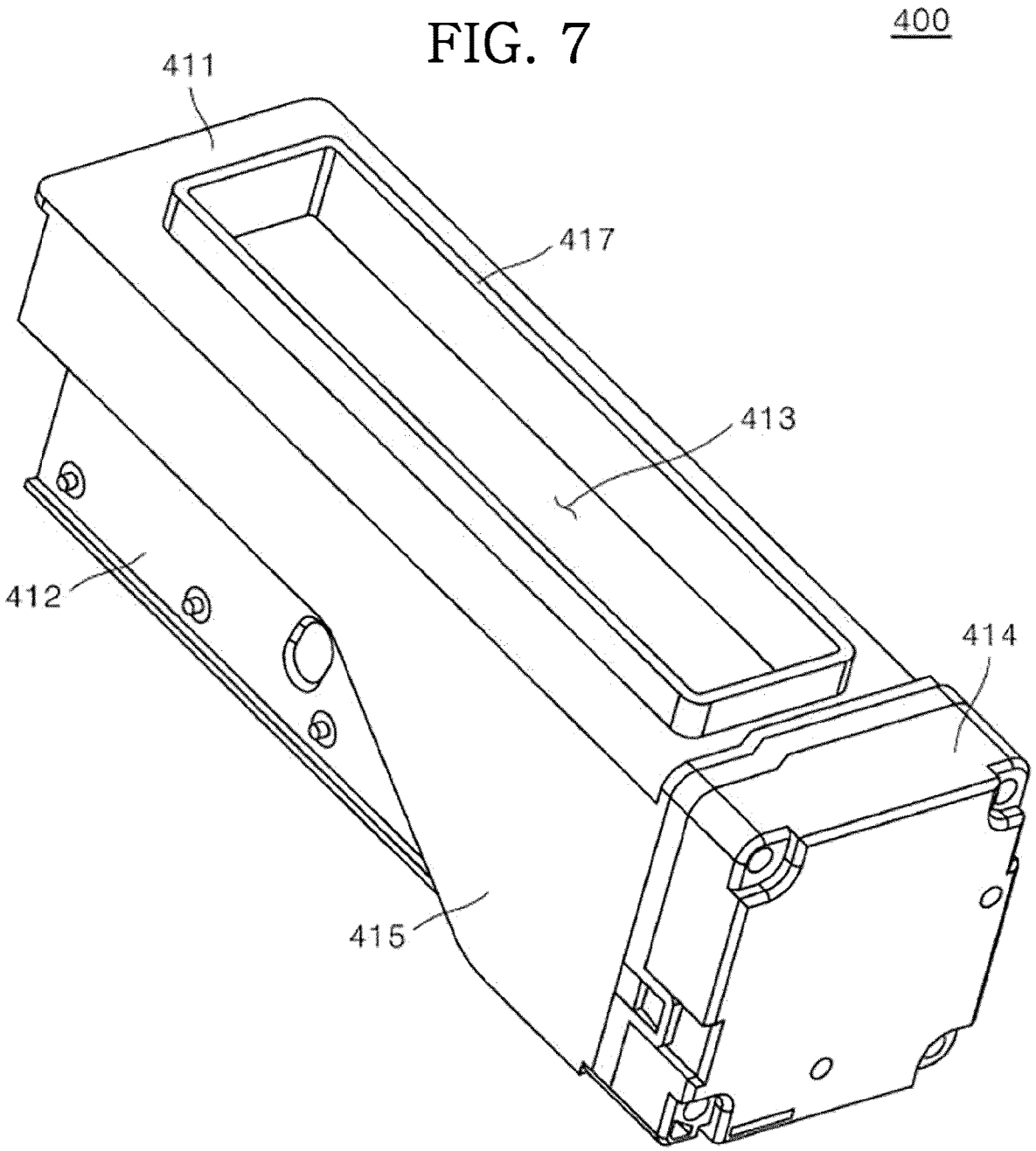
FIG. 7 is a perspective view illustrating a state in which the damper door of the damper is opened.

FIG. 5 is an exploded perspective view of the grille fan assembly. In addition, FIG. 6 is a perspective view illustrating a state in which the damper door of the damper is closed. In addition, FIG. 7 is a perspective view illustrating a state in which the damper door of the damper is opened.

The grille fan assembly 300 may include a shroud 320 and a grille fan 310.

The shroud 320 may define a rear-side outer appearance of the grille fan assembly 300, and the grille fan 310 may define a front-side outer appearance of the grille fan assembly 300.

The cold air heat-exchanged while passing through the evaporator 340 may be introduced into a space between the shroud 320 and the grille fan 310 through the fan module 330, and the introduced cold air may be suppled into the freezing compartment 42 through the cold air outlet 311 provided in the grille fan 310.

In addition, the cold air introduced into the space between the shroud 320 and the grille fan 310 through the fan module 330 may communicate with the supply duct assembly 200 through the grille fan cold air outlet 3120 provided at one side of the shroud 320.

The supply of the cold air supplied to the supply duct assembly 200 may be controlled by opening and closing the passage opening/closing module 400.

The passage opening/closing module 400 may include a damper 410 and a damper cover 420 surrounding the damper 410. The damper 410 and the damper cover 420 are configured to selectively block the cold air supplied to the supply duct assembly 200.

The damper cover 420 may include a first damper cover 421 and a second damper cover 422, which respectively cover one side and the other side of the damper 410.

Referring to FIGS. 6 and 7, the damper 410 may include a damper case 411, a damper door 412, and a damper operation motor 414.

The damper case 411 may have a square frame structure including a damper through-hole 413 through which the cold air toward the refrigerating compartment 41 passes in a central region.

The damper through-hole 413 may be defined to communicate with the cold air passage of the supply duct assembly 200 toward the refrigerating compartment 41.

The damper door 412 may be disposed on one surface of the damper case 411, and the one surface of the damper case 411 may have a flat shape to be closely coupled to the damper door 412.

A damper mounting guide portion 417 extending upward along the damper through-hole 413 may be disposed on the other surface of the damper case 411. The damper mounting guide portion 417 may guide a direction of the cold air passing through the damper through-hole 413.

A damper blocking portion 415 may be disposed on one surface of the damper case 411. The damper blocking portion 415 may adjust a rotation angle of the damper door 412 so that the damper door 412 is not excessively opened.

A damper heating wire may be further disposed on one surface of the damper case 411 along a peripheral portion of the damper through-hole 413. The damper heating wire may be an area on which the damper case 411 and the damper door 412 are in direct contact with each other.

If the damper door 412 of the damper 410 does not operate properly when being frozen, the freezing may be solved through a defrosting operation by applying heat to the damper heating wire.

The damper door 412 may be disposed on one surface of the damper case 411. The damper door 412 may selectively block the cold air from passing through the damper through-hole 413.

Therefore, in the case of blocking the cold air, the damper door 412 may be in contact with one surface of the damper case 411 to block the damper through-hole 413, and in the case of allowing the cold air to pass, the damper door 412 may rotate in one direction to open the damper through-hole 413.

The damper door 412 may have an area greater than that of the damper through-hole 413 so that an edge portion thereof is in contact with the damper case 411, and thus, when the damper door 412 is closed, the cold air may be effectively blocked.

The damper operation motor 414 may be disposed at one side of the damper case 411. The damper operation motor 414 may control the rotation of the damper door 412. A motor shaft of the damper operation motor 414 is shaft-coupled to a rotation hinge shaft of the damper door 412 to control the rotation of the damper door 412.

One surface of the damper case 411 is disposed toward the inside of the grille fan assembly 300. The damper door 412 may be opened and closed in an inward direction of the grille fan assembly 300 to reduce the area of the damper door 412 exposed to the outside.

Only a portion of the damper door 412 may be exposed in a direction in which the damper door 412 communicates with the supply duct assembly 200. Thus, since an area of an injection-molded object that is vulnerable to the cold air can is capable of being reduced, possibility of the freezing of the damper door 412 may be reduced.

Hereinafter, each configuration of the passage opening/closing module will be described in more detail.

Figure 8:
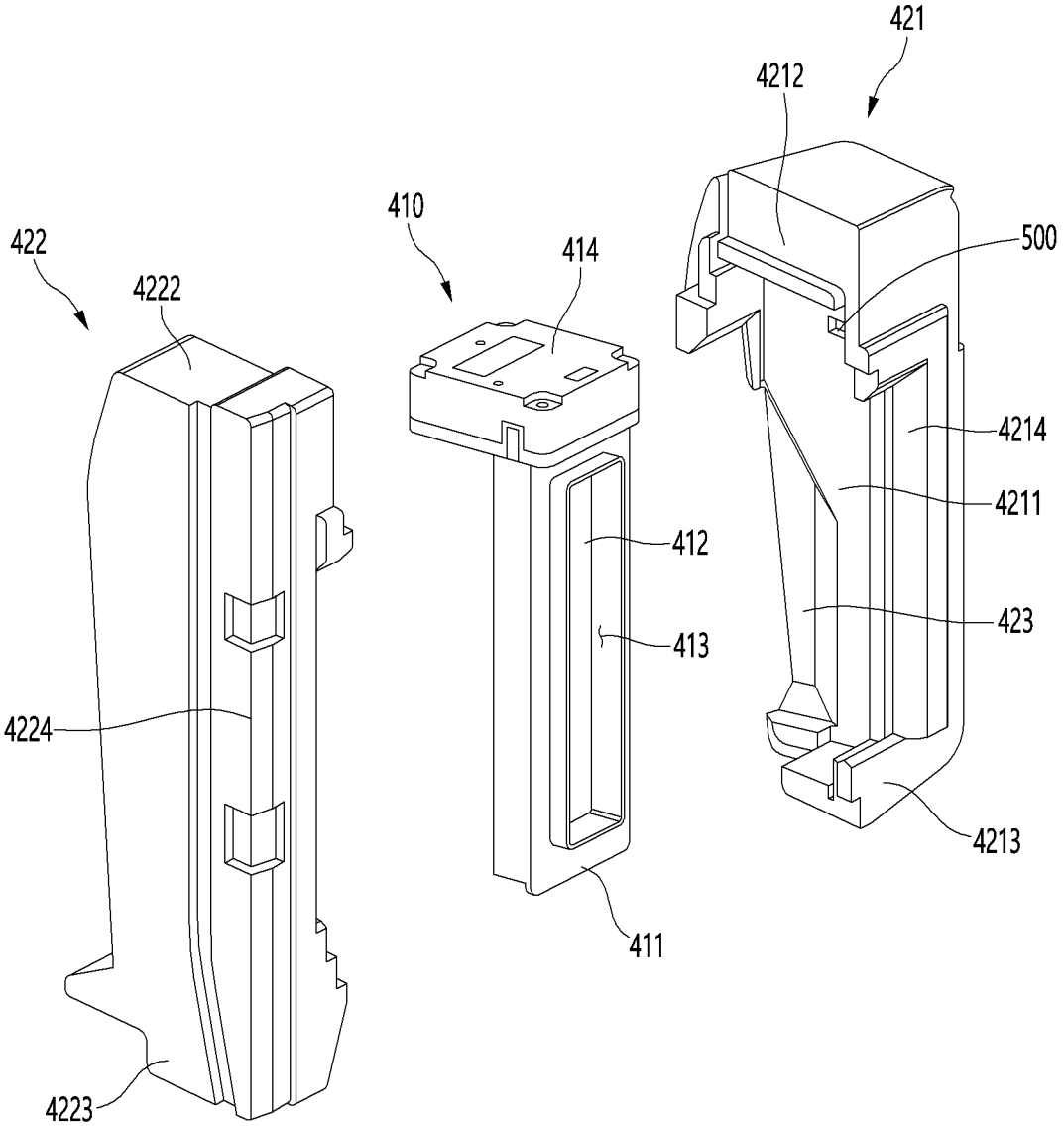
FIG. 8 is an exploded perspective view of a passage opening/closing module.
Figure 9:
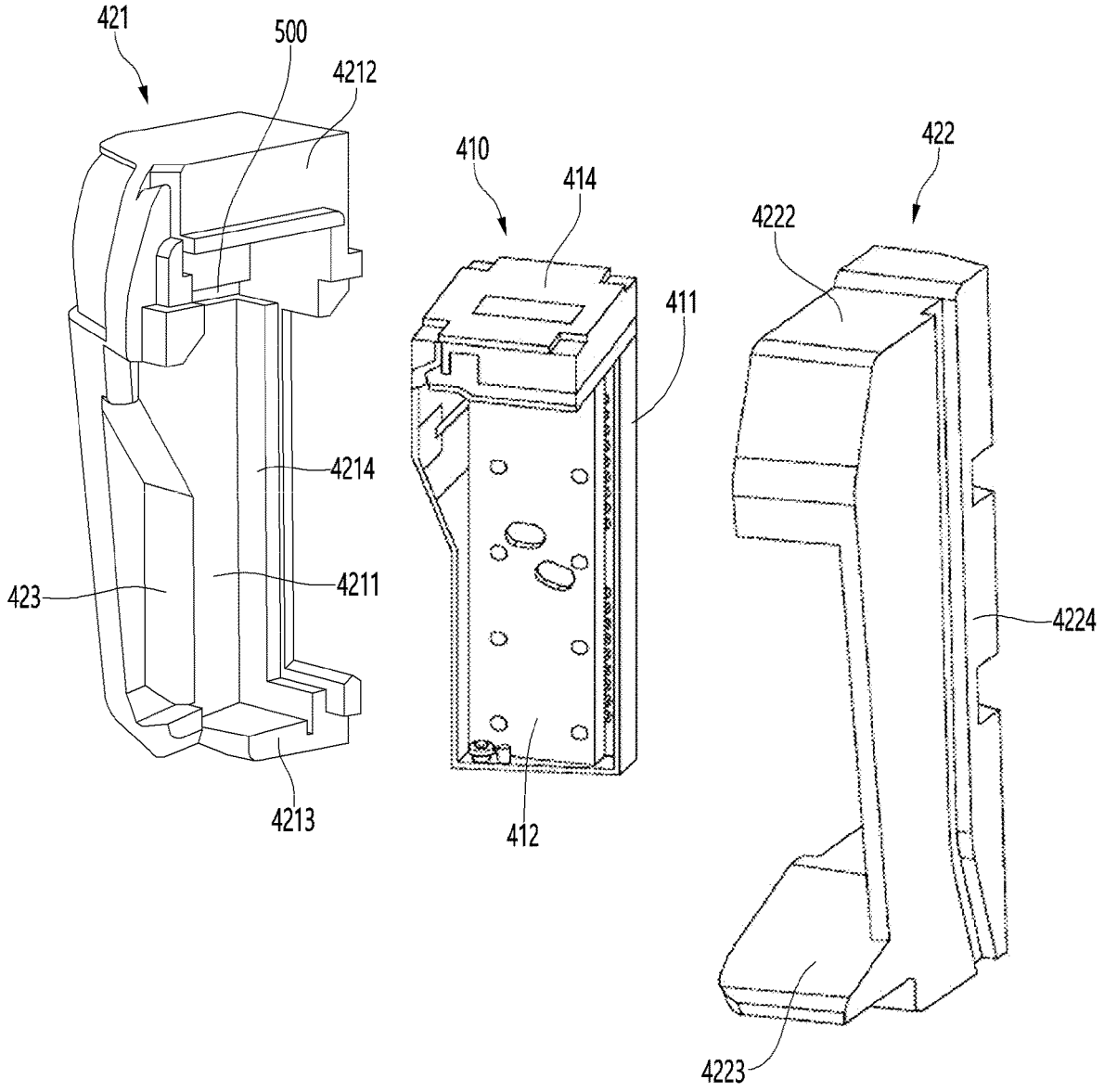
FIG. 9 is an exploded perspective view of the passage opening/closing module when viewed from another side.

FIG. 8 is an exploded perspective view of the passage opening/closing module. FIG. 9 is an exploded perspective view of the passage opening/closing module when viewed from another side.

The passage opening/closing module 400 may include a damper 410 and a damper cover 420 surrounding the damper 410. The damper 410 and the damper cover 420 are configured to selectively block the cold air supplied to the supply duct assembly 200.

The damper cover 420 may include a first damper cover 421 and a second damper cover 422, which respectively cover one side and the other side of the damper 410.

The first damper cover 421 may be disposed closer to the shroud 320 of the grille fan 310 and the shroud 320. The first damper cover 421 may be provided at a position corresponding to a position at which the fan module 330 is mounted based on a vertical direction of the shroud 320.

The second damper cover 422 may be disposed closer to the grille fan 310 of the grille fan 310 and the shroud 320 at a position facing the first damper cover 421. A front surface of the second damper cover 422 may be disposed in a direction facing a rear surface of the grille fan 310.

The damper door 412 may be opened in a direction in which the first damper cover 421 is disposed. That is, the damper door 412 may be opened and closed in the direction of the grille fan assembly 300.

The first damper cover 421 includes a first cover portion 4211 that is recessed to accommodate at least a portion of the damper 410. The first damper cover 421 includes a second cover portion 4212 that extends upward to define a top surface and is in contact with the damper operation motor 414 with respect to the first cover portion 4211.

The first damper cover 421 includes a third cover portion 4213 extending in one direction from a lower end of the first cover portion 4211.

A cover edge portion 4214 protruding in a direction in which the damper 410 is provided is disposed at one side of the first cover portion 4211. The cover edge portion 4214 may extend from the second cover portion 4212 to the third cover portion 4213. The cover edge portion 4214 may be disposed to surround at least a portion of one surface of the damper 410.

The first damper cover 421 may include a damper cover stepped portion 423 disposed to overlap at least a portion of the damper door 412 when the damper door 412 is opened.

The damper cover stepped portion 423 may be an area on which a portion of the first damper cover 421 is removed, and the cold air passage through which a portion of the cold air flows may be provided through the damper cover stepped portion 423.

The cold air blown from the grille fan assembly 300 may flow into the cold air passage provided between the damper door 412 and the second damper cover 422 to pass through the damper through-hole 413.

In addition, the cold air blown from the grille fan assembly 300 may pass through the damper through-hole 413 through the cold air passage provided between the damper door 412 and the damper cover stepped portion 423.

Since a partial area of the first damper cover 421 on the area corresponding to the damper cover stepped portion 423 is removed, the flow of the cold air flowing into the cold air passage may more naturally flow to increase in amount of cold air passing through the damper through-hole 413.

As described above, the passage opening/closing module 400 may be provided with the first damper cover 421 at one side and the second damper cover 422 at the other side with respect to the damper 410. The passage opening/closing module 400 may be configured to selectively block the cold air introduced by the fan module 330 of the grille fan assembly 300 from flowing into the supply duct assembly 200.

Since the damper through-hole 413 is opened and closed by the damper door 412, the cold air flowing into the damper through-hole 413 may be selectively blocked. When the damper door 412 opens and closes the damper through-hole 413, the cold air passing through the damper through-hole 413 may be introduced toward the supply duct assembly 200.

In the state in which the damper through-hole 413 is closed by the damper door 412, the introduction of the cold air toward the supply duct assembly 200 through the damper through-hole 413 may be blocked.

In an embodiment, an anti-freezing passage 500 provided so that at least a portion of the cold air is discharged even when the damper through-hole 413 is closed by the damper door 412 may be provided. The cold air introduced into the anti-freezing passage 500 may be guided toward the supply duct assembly 200 to prevent the wet air in the supply duct assembly 200 from flowing backward to the passage opening/closing module 400.

Hereinafter, the anti-freezing passage 500 will be described in detail.

Figure 10:
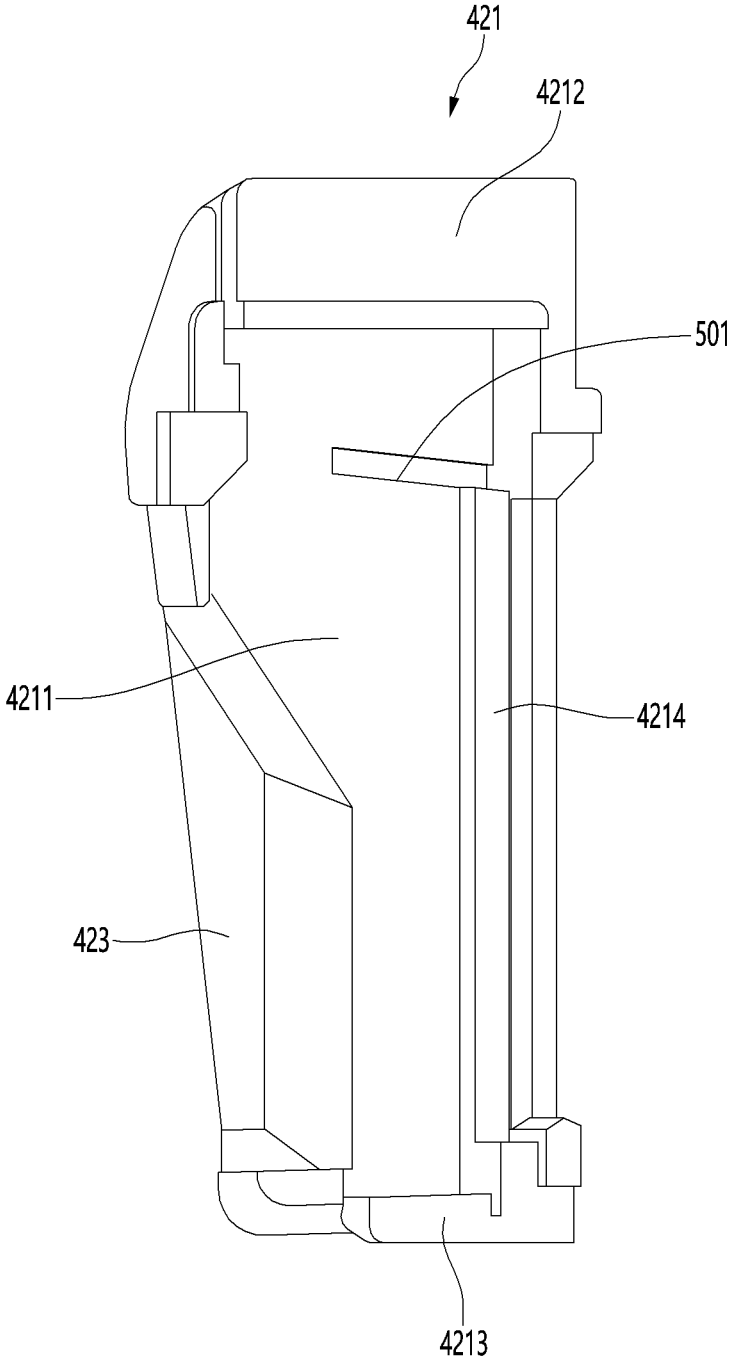
FIG. 10 is a view for explaining an anti-freezing passage.
Figure 11:
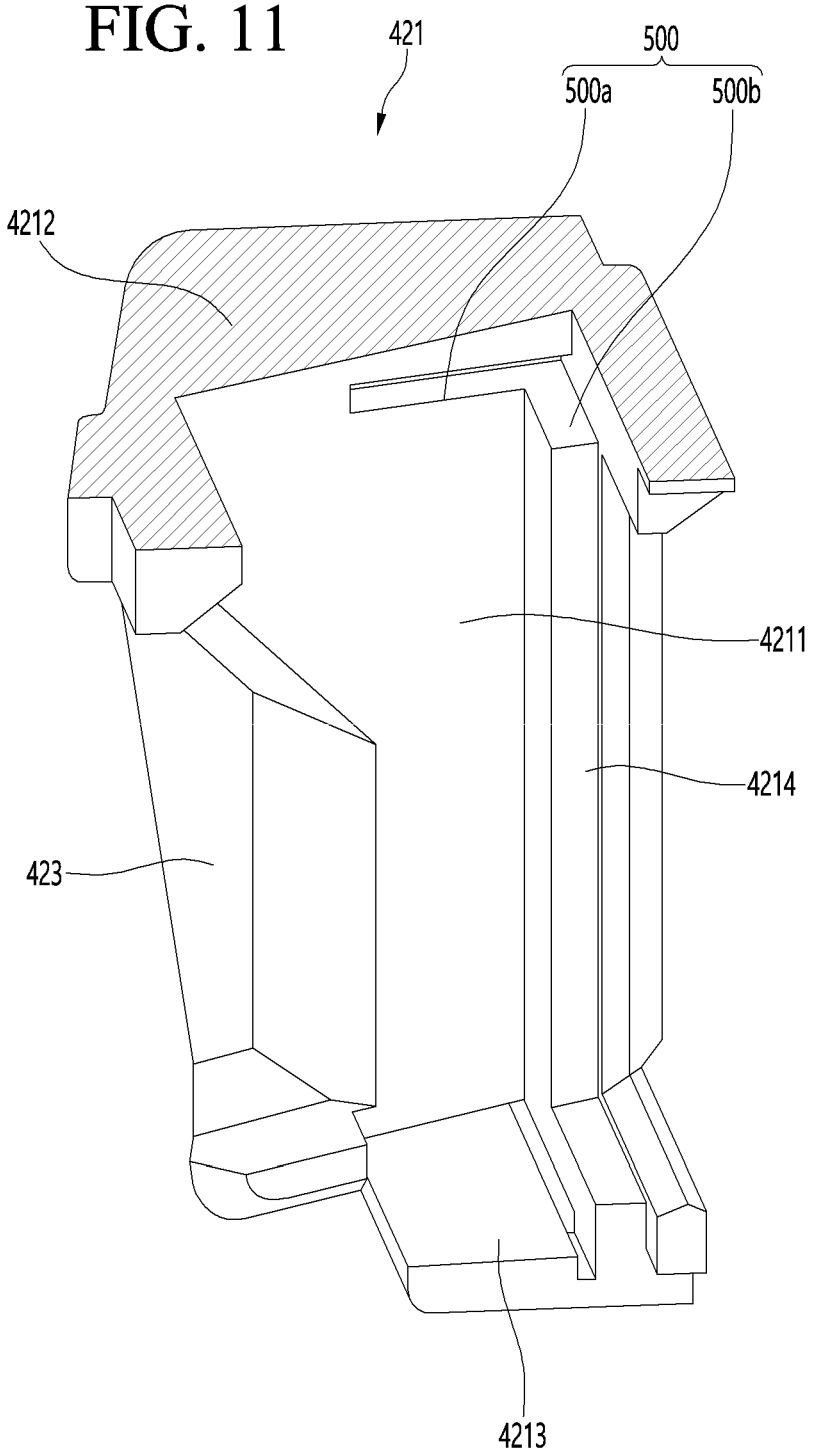
FIG. 11 is a cross-sectional view for explaining the anti-freezing passage.
Figure 12:
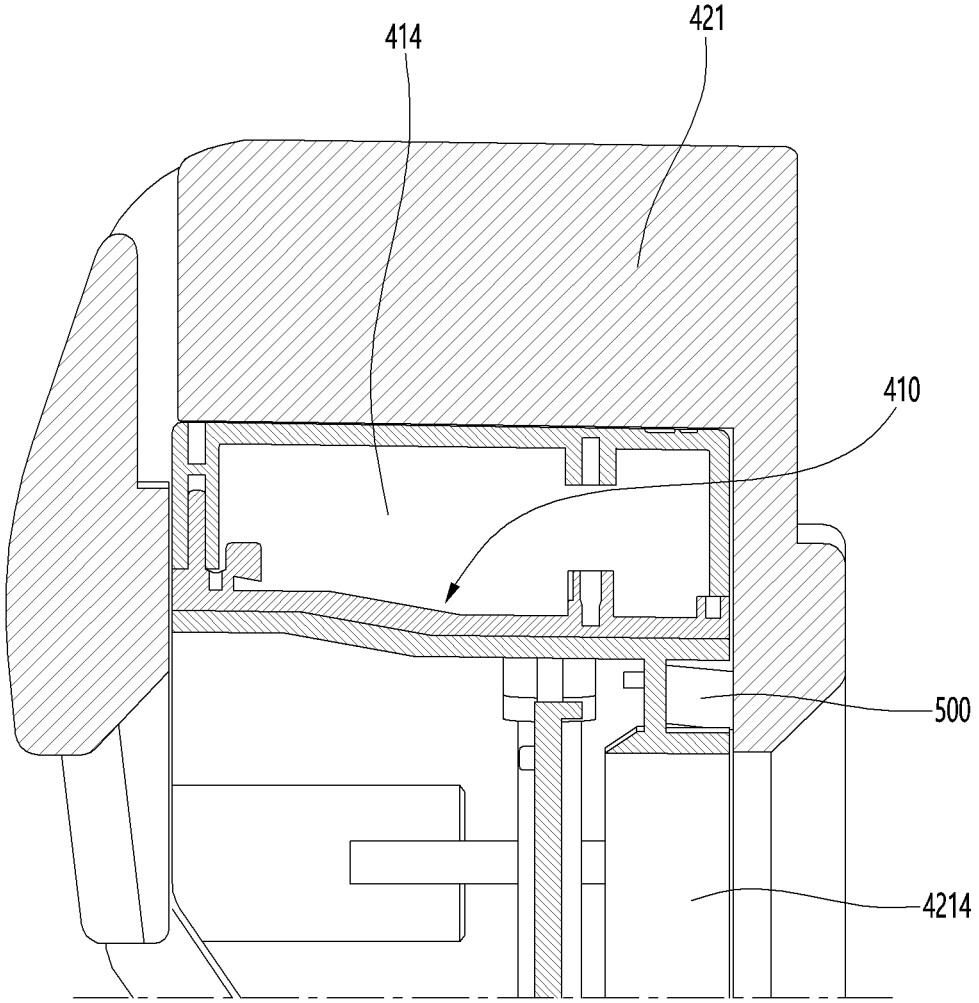
FIG. 12 is a view for explaining the anti-freezing passage in a state in which the passage opening/closing module is coupled.

FIG. 10 is a view for explaining the anti-freezing passage. In addition, FIG. 11 is a cross-sectional view for explaining the anti-freezing passage. In addition, FIG. 12 is a view for explaining the anti-freezing passage in the state in which the passage opening/closing module is coupled.

The anti-freezing passage 500 may discharge a portion of the cold air blown by the fan module 330 even when the damper door 412 closes the damper through-hole 413.

When the passage opening/closing damper 410 is closed, since the cold air is not discharged through the supply duct cold air outlet 2120, the wet air in the refrigerating compartment 41 may flow backward to the supply duct assembly 200. The damper 410 may be frozen by the wet air flowing backward from the refrigerating compartment 41.

A small amount of cold air may be discharged through the anti-freezing passage 500 to supplement the cold air, thereby preventing the wet air from being introduced. Therefore, the main cause of freezing of the damper 410 may block the influence of the wet air flowing backward from the refrigerating compartment 41.

The anti-freezing passage 500 may be disposed at a position corresponding to a position at which the fan module 330 is mounted. The anti-freezing passage 500 may be disposed adjacent to the grille fan cold air outlet 3120. At least a portion of the cold air blown by the fan module 330 may be guided to the anti-freezing passage 500.

The anti-freezing passage 500 may be disposed on an upper end of the damper cover 420 in a vertical direction. The anti-freezing passage 500 may be a space that is recessed inward from an upper end of the first damper cover 421 and spaced a predetermined interval from the damper 410.

The anti-freezing passage 500 may be provided to be spaced a set interval downward from the upper end of the first cover portion 4211. The anti-freezing passage 500 may be provided at a position corresponding to an upper end of the damper blocking portion 415.

A lower end of the anti-freezing passage 500 may be provided at a position corresponding to the upper end of the damper through-hole 413 in a state in which the damper 410 is mounted on the damper cover 420. The anti-freezing passage 500 may be provided at a position corresponding to the lower end of the damper operation motor 414.

One end of the anti-freezing passage 500 may be disposed at a central portion of the first cover portion 4211, and the other end may be disposed at one end of the first cover portion 4211. In other words, the anti-freezing passage 500 may extend from the central portion of the first cover portion 4211 to the other end, instead of extending from one end to the other end of the first cover portion 4211.

For example, the anti-freezing passage 500 may have one end disposed at a center of the first cover portion 4211 and extend in one direction to extend up to the cover edge portion 4214. The other end of the anti-freezing passage 500 may be connected to the cover edge portion 4214.

When a starting point of the anti-freezing passage 500 is disposed at one end of the first cover portion 4211, the cold air may be discharged beyond the area occupied by the damper 410. In addition, when the starting point of the anti-freezing passage 500 extends from one end of the first cover portion 4211 to the other end of the first cover portion 4211, a flow rate of the cold air discharged through the anti-freezing passage 500 may be excessive. When the flow rate of the cold air discharged from the anti-freezing passage 500 is out of a set range, the freezing compartment or the refrigerating compartment may be overcooled, and thus, cooling efficiency may be deteriorated.

The flow rate of the cold air discharged through the anti-freezing passage 500 toward the supply duct assembly 200 may be proportional to the area on which the anti-freezing passage 500 is provided.

If the area of the anti-freezing passage 500 is excessively large, the flow rate of the discharged cold air may be excessive, and thus, overcooling or power outage may occur.

For example, the flow rate of the cold air discharged to the anti-freezing passage 500 may be less than about 1%, preferably less than about 0.5% based on 100% of the flow rate of the cold air discharged by the fan module 330. Within this range, the freezing within the damper 410 may be effectively prevented.

For example, the anti-freezing passage 500 may have a width extending from the center of the first cover portion 4211 to one end of the first cover portion 4211 in a range of about 20 mm to about 40 mm, preferably about 25 mm to about 35 mm.

For example, the anti-freezing passage 500 may have a length extending from a lower end to an upper end thereof, that is, a height of about 3 mm to about 10 mm, preferably about 3 mm to about 7 mm.

For example, the anti-freezing passage 500 may have a depth of about 1 mm to about 10 mm, preferably about 3 to about 6 mm, which is recessed inward from an outer surface of the first cover portion 4211.

The anti-freezing passage 500 may extend in a direction crossing the direction in which the damper through-hole 413 extends.

The anti-freezing passage 500 may include an inclined portion 501 that is inclined downward as extending from the center of the first cover portion 4211 to one end of the first cover portion 4211.

The inclined portion 501 may extend downward as getting closer to the cover edge portion 4214. When defrosting water is generated, the inclined portion 501 may guide the defrosting water to fall downward. When the defrosting water is generated in the anti-freezing passage 500, the inclined portion 501 may allow the defrosting water to be discharged toward the cover edge portion 4214 along the inclined portion 501 without pooling.

The anti-freezing passage 500 may further extend between the upper end of the cover edge portion 4214 and the second cover portion 4212.

The anti-freezing passage 500 may include a first prevention passage 500*a* provided by being recessed from the first cover portion 4211 and a second prevention passage 500*b* extending from an end of the first cover portion 4211 toward the damper 410.

The second prevention passage 500*b* may be bent to extend from an end of the first prevention passage 500*a* and then be disposed between an upper end of the cover edge portion 4214 and a lower end of the second cover 4212.

The second prevention passage 500*b* may guide the cold air toward the grille fan assembly 300.

The second damper cover 422 may include a damper mounting portion 4221 in which at least a portion of the damper 410 is accommodated. The second damper cover 422 includes a top surface portion 4222 defining a top surface and a bottom surface portion 4223 defining a bottom surface with respect to the damper mounting portion 4221.

The second damper cover 422 includes a second cover edge portion 4224 that extends from the damper mounting portion 4221 in one direction to connect the top surface portion 4222 to the bottom surface portion 4223. The second cover edge portion 4224 may be disposed to surround a peripheral portion of the damper through-hole 413.

Figure 13:
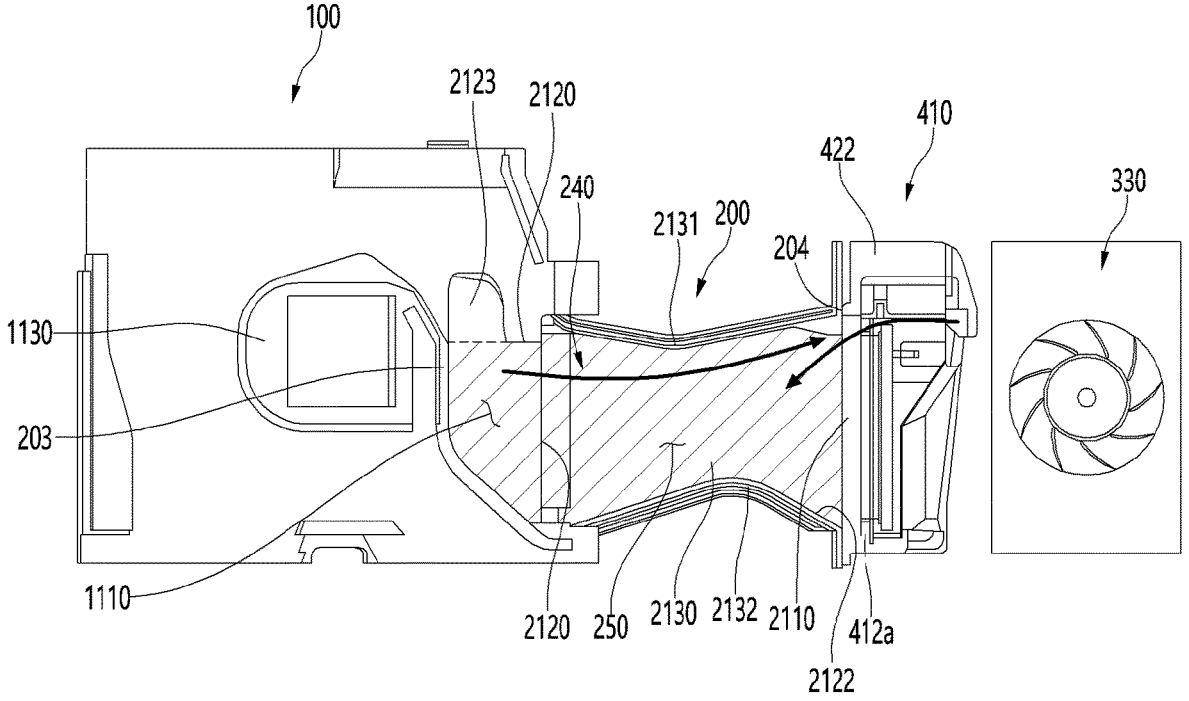
FIG. 13 is a view illustrating a cold air passage through which cold air flows in a state in which a damper door of the passage opening/closing module is closed.

FIG. 13 is a view illustrating the cold air passage through which the cold air flows in the state in which the damper door of the passage opening/closing module is closed.

The supply duct cold air outlet 2120 may be provided at one side of the supply duct assembly 200 to communicate with the passage duct cold air inlet 1110 of the passage duct assembly 100.

Thus, the supply duct cold air outlet 2120 may be provided in a shape corresponding to the passage duct cold air inlet 1110.

The supply duct cold air inlet 2110 may be provided at the other side of the supply duct assembly 200, and thus, the cold air blown from the grille fan assembly 300 may be introduced.

The supply duct cold air inlet 2110 may be provided in a size corresponding to the shape of the damper door 412 exposed to the outside from the passage opening/closing module 400. In this case, the area of the damper door 412 exposed to the wet air may be reduced as much as possible.

Heating portions may be additionally attached to one side and the other side of the supply duct assembly 200, respectively. The plurality of heating portions may be heaters that generate heat during a defrosting operation.

An upper side of the supply duct cold air outlet 2120 may include a stepped portion 2123 by which an opening area decreases from one side 203 to the other side 204 of the supply duct assembly 200. The stepped portion 2123 may provide a barrier structure that prevents the wet air 240 from being introduced into the supply duct assembly 200.

A supply duct connection portion 2130 may be disposed between the supply duct cold air outlet 2120 and the supply duct cold air inlet 2110, and an upper side of the supply duct connection portion 2130 may include an upper lead-in portion 2131 that is drawn inward.

The cold air flowing into the supply duct cold air outlet 2120 may be primarily blocked from being introduced by the stepped portion 2123 functioning as the barrier structure and may be secondarily prevented from being introduced by the upper lead-in portion 2131 functioning as a barrier structure.

In addition, a lower side of the supply duct connection portion 2130 may include a lower lead-in portion 2132 that is drawn inward.

The lower lead-in portion 2132 may be connected to a second lower inclined portion 2122 to provide an inclined structure, which is configured to discharge the defrosting water to the outside, in the supply duct connection portion 2130.

The upper lead-in portion 2131 and the lower lead-in portion 2132 may be disposed so as not to overlap each other in the vertical direction.

Since the upper lead-in portion 2131 and the lower lead-in portion 2132 are disposed so as not to overlap each other in the vertical direction, an interference with the flow of the cold air may be reduced.

The supply duct cold air inlet 2110 provided at the other side 204 of the supply duct assembly 200 may communicate with the grille fan cold air outlet 3120, and specifically, the passage opening/closing damper 410.

The damper 410 may be disposed to be elongated in the vertical direction.

For example, the rotation axis 412*a* of the damper door may be disposed parallel to the supply duct cold air inlet 2110 of the supply duct assembly 200.

As described above, since the damper 410 is disposed in the vertical direction, the flow of the cold air discharged to the supply duct cold air inlet 2110 may be naturally induced.

In addition, when the damper 410 is disposed to have an inclination, the defrosting water may not be discharged to the outside in a state of pooling on the inclined stepped portion. However, the damper 410 may be disposed vertically, rather than obliquely, to reduce the defrosting water pooling on the stepped portion.

An uppermost end of the damper through-hole 413 may be disposed lower than an uppermost end of the passage duct cold air inlet 1110.

Even when the damper 410 is closed, the cold air already introduced may provide a space of a cold air trap 250 that fills the space of the supply duct assembly 200 with cold air from the uppermost end to the lowermost end of the damper through-hole 413 of the damper 410.

When the space of the cold air trap 250 is defined in the supply duct assembly 200 in this manner, the wet air 240 flowing back to the supply duct assembly 200 may be trapped in the cold air trap 250 to reduce the inflow of the wet air 240.

Therefore, the wet air 240 may be trapped in the cold air trap 250 by positioning the uppermost end of the damper through-hole 413 lower than the uppermost end of the passage duct cold air inlet 1110.

In addition, the anti-freezing passage 500 may guide a portion of the cold air blown from the fan module 330 in the state in which the damper through-hole 413 is closed by the damper door 412 toward the direction in which the supply duct assembly 200 is provided.

Even if the wet air in the supply duct assembly 200 flows backward to the passage opening/closing module 400, the cold air discharged from the anti-freezing passage 500 may block the cold air flowing backward toward the passage opening/closing module 400.

Thus, the freezing of the damper 410 may be prevented from occurring even when the wet air flows backward.

Figure 14:
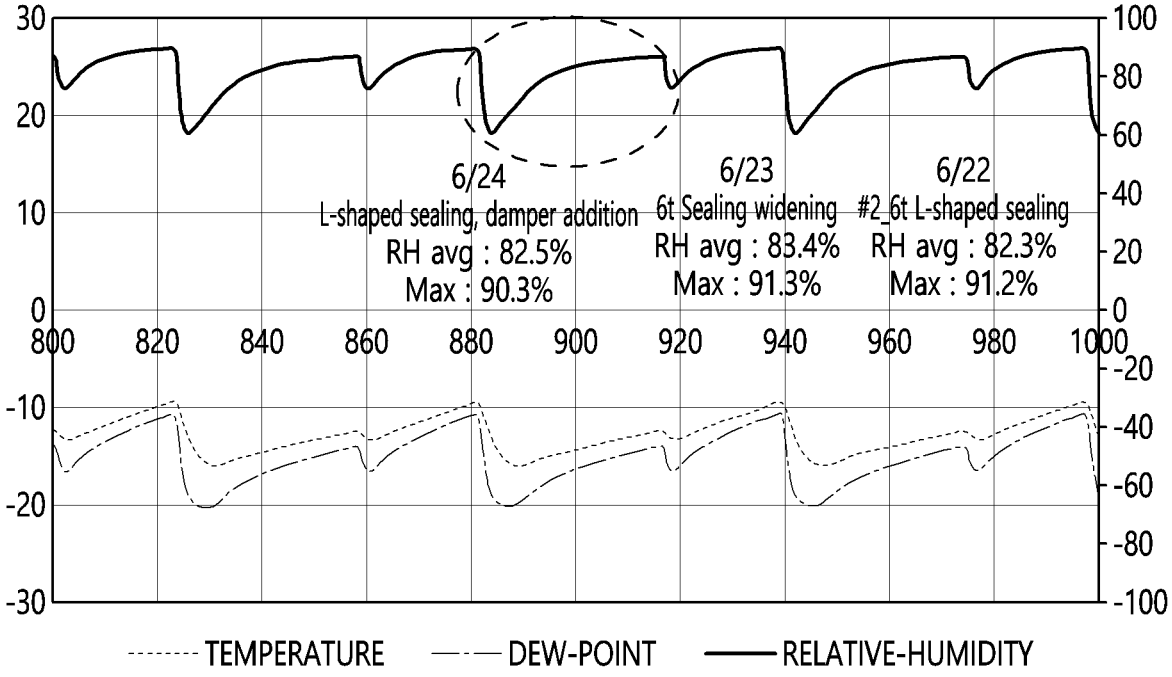
FIG. 14 are graphs illustrating results obtained by comparing relative humidity before and after application of the anti-freezing passage.
Figure 14:
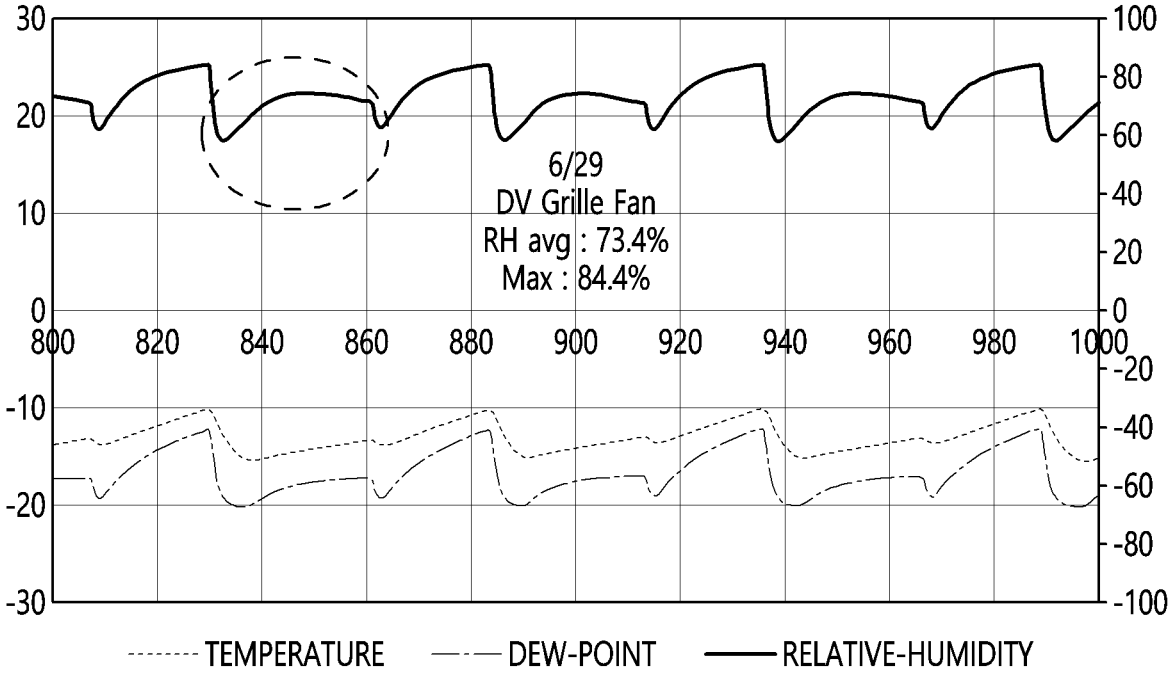

FIG. 14 are graphs illustrating results obtained by comparing relative humidity before and after application of the anti-freezing passage.

FIG. 14(*a*) is a graph illustrating a change in relative humidity when the fan module 330 operates in the state in which the damper passage hole 413 is closed by the damper door 412 before the anti-freezing passage is applied.

As described above, when one cycle operation is performed under an exclusive operation of the freezing compartment, a maximum relative humidity in the grille fan assembly was measured at about 90.3%, and an average relative humidity was measured at about 82.5%.

FIG. 14(*b*) is a graph illustrating a change in relative humidity when the fan module 330 operates in the state in which the damper passage hole 413 is closed by the damper door 412 after the anti-freezing passage is applied.

As described above, when one cycle operation is performed under an exclusive operation of the freezing compartment, a maximum relative humidity in the grille fan assembly was measured at about 84.4%, and an average relative humidity was measured at about 73.4%. That is, it is confirmed that the relative humidity inside the grille fan assembly is reduced as the anti-freezing passage is added. That is, the anti-freezing passage 500 may be added to block the wet air flowing backward in the supply duct assembly 200, thereby preventing the freezing in the damper 410 from occurring.

The anti-freezing passage 500 is not limited to the above-described embodiment and may be provided in various shapes.

Figure 15:
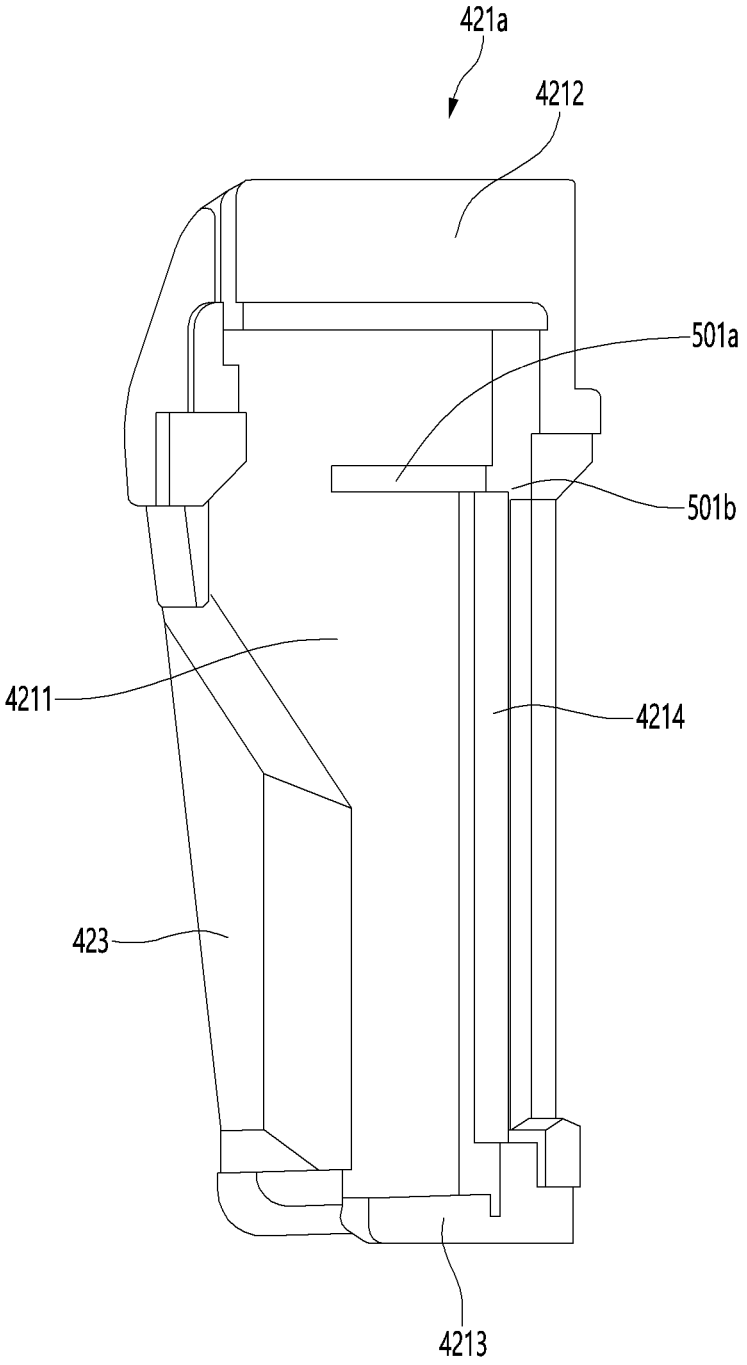
FIG. 15 is a view illustrating a passage opening/closing module according to another embodiment.

FIG. 15 is a view illustrating a passage opening/closing module according to another embodiment.

A passage opening/closing module according to another embodiment may have the same configuration as the above-described embodiment, except for the shape of the anti-freezing passage 500.

An anti-freezing passage 501*a* according to another embodiment may be disposed on a damper cover 420. The anti-freezing passage 501*a* may extend from a center of the damper cover 420 up to one end. Here, the anti-freezing passages 501*a* according to another embodiment may extend parallel to a horizontal direction. In other words, a height of one end of the anti-freezing passage 501*a* and a height of the other end of the anti-freezing passage 501*a* may be provided to be the same. That is, an inclined portion 501 may be disposed on the anti-freezing passage 500 in the above-described embodiment, but the inclined portion 501 may not be disposed on the anti-freezing passage 500*a* in another embodiment.

The anti-freezing passage 500*a* according to another embodiment may be disposed in a direction perpendicular to a direction in which a damper through-hole 413 extends.

The anti-freezing passage 500*a* may include a first prevention passage 501*a* extending from the center of the damper cover 420 up to one end, and a second prevention passage 501*b* bent from an end of the first prevention passage 501*a* to extend along a cover edge portion 4214.

Figure 16:
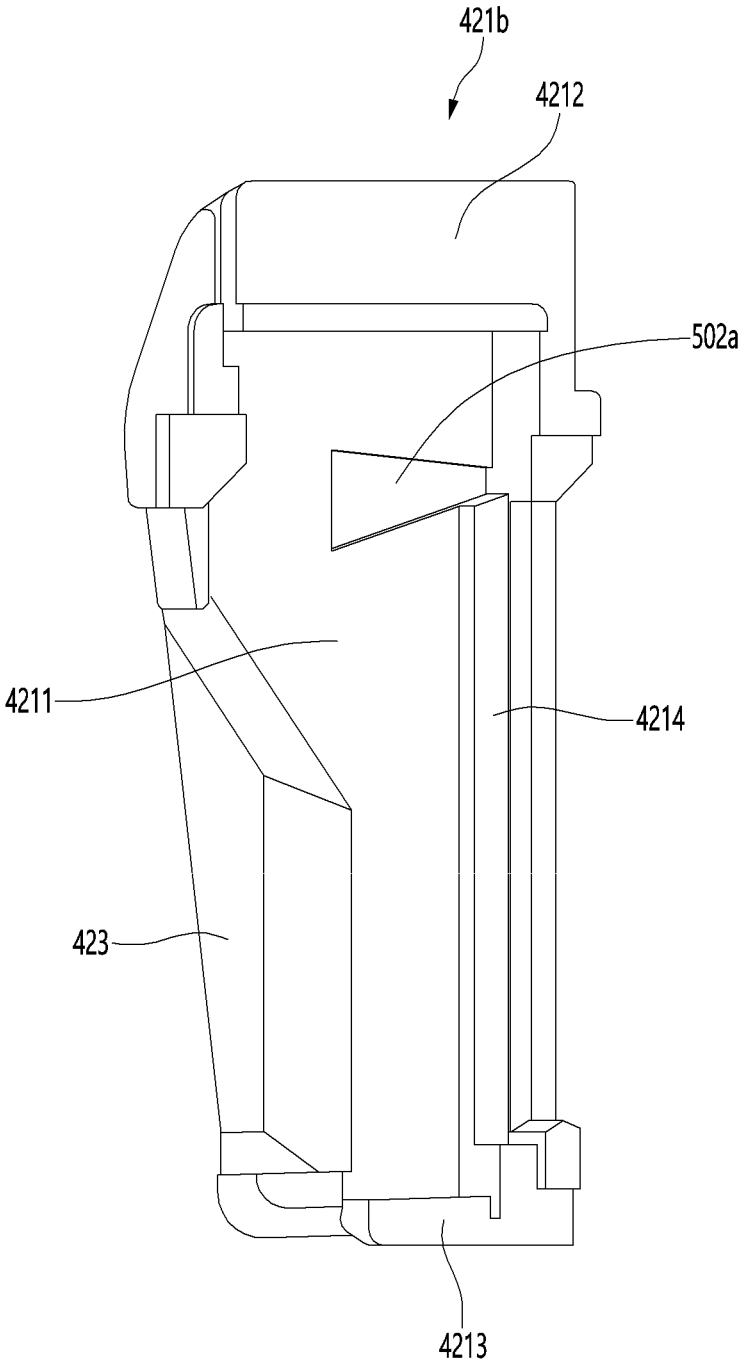
FIG. 16 is a view illustrating a passage opening/closing module according to further another embodiment.

FIG. 16 is a view illustrating a passage opening/closing module according to further another embodiment.

The passage opening/closing module according to further another embodiment may have the same configuration as the above-described embodiment, except for the shape of the anti-freezing passage 502*a*.

The anti-freezing passage 502*a* according to further another embodiment may be disposed on a damper cover 420. The anti-freezing passage 502*a* may be disposed to extend from a central portion of the damper cover 420 up to one end. Here, the anti-freezing passage 502*a* according to further another embodiment may be provided in a shape in which an area thereof is narrowed toward one end of the damper cover 420.

In other words, the area of the anti-freezing passage 502*a* may be maximized at the central portion of the damper cover 420, and the area of the anti-freezing passage 502*a* may gradually decreases as extending to one end of the damper cover 420.

A recessed depth in the central portion of the damper cover 420 to provide the anti-freezing passage 502*a* may be less than a recessed depth from one end of the damper cover 420.

As described above, the anti-freezing passage may be provided in various shapes to guide a portion of cold air guided to a fan module 330 to the inside of a passage opening/closing module 400 in a state in which a damper through-hole 413 is closed by a damper door 412.

The refrigerator according to the present disclosure may include the anti-freezing passage in the passage opening/closing damper that selectively blocks the cold air from the supply duct assembly. The anti-freezing passage may allow a portion of the cold air guided by the fan module to pass even when the damper through-hole is closed by the damper door.

Therefore, the wet air within the supply duct assembly may be prevented from flowing backward to prevent the damper from being frozen.

Although the embodiments are exemplified with respect to the accompanying drawings, those having ordinary skill in the art to which the present invention pertains will be understood that the present invention can be carried out in other specific forms without changing the technical idea or essential features. In addition, although explaining the embodiments of the present invention and explaining the operation and effect according to the constitution of the present invention have not been explicitly described, it is needless to say that a predictable effect is also recognized by the constitution.

What is claimed is:

1. A refrigerator comprising:

a first storage space;

a second storage space located at one side of the first storage space;

a passage duct assembly located behind the second storage space, the passage duct assembly having a cold air passage;

a grille fan assembly located behind the first storage space, the grille fan assembly having a fan configured to blow cold air;

a supply duct assembly configured to supply the cold air from the grille fan assembly to the passage duct assembly; and a passage opening/closing module configured to selectively block the cold air supplied to the supply duct assembly, the passage opening/closing module having:

a damper having a damper through-hole through which the cold air passes and a damper door configured to open and close the damper through-hole; and a damper cover configured to surround at least a portion of the damper, the damper cover having an anti-freezing passage through which a portion of the cold air blown from the grille fan assembly is discharged to the supply duct assembly when the damper through-hole is closed, wherein at least a portion of the anti-freezing passage overlaps with the damper through-hole with respect to a horizontal direction, and wherein the anti-freezing passage comprises an inclined portion that is inclined downward toward one side of the damper cover.

2. The refrigerator according to claim 1, wherein the anti-freezing passage is located in an upper end of the damper cover with respect to a vertical direction of the damper cover.

3. The refrigerator according to claim 1, wherein the anti-freezing passage is located at a position corresponding to a position at which the fan is mounted.

4. The refrigerator according to claim 1, wherein the damper cover comprises a first cover portion, and wherein the anti-freezing passage is recessed inward from the first cover portion, the anti-freezing passage being spaced a set interval from the damper.

5. The refrigerator according to claim 4, wherein the anti-freezing passage has a first end located at a central portion of the first cover portion and a second end located at one side of the first cover portion.

6. The refrigerator according to claim 5, wherein the inclined portion of the anti-freezing passage is inclined downward toward the one side of the first cover portion.

7. The refrigerator according to claim 5, wherein the anti-freezing passage extends in a direction crossing a direction in which the damper through-hole extends.

8. The refrigerator according to claim 5, wherein the anti-freezing passage has an area that gradually decreases toward one side of the damper cover.

9. The refrigerator according to claim 1, wherein the damper cover further comprises a first damper cover and a second damper cover, which are configured to surround a first side of the damper and a second side of the damper, respectively, wherein the damper door is configured to open in a direction toward the first damper cover, and wherein the anti-freezing passage is located in the first damper cover.

10. The refrigerator according to claim 9, wherein the first damper cover comprises:

a first cover portion;

a second cover portion configured to define a top surface of the first damper cover; and a cover edge portion configured to protrude from one side of the first cover portion away from the damper.

11. The refrigerator according to claim 10, wherein the damper includes a motor configured to open and close the damper door, the motor contacting the second cover portion, and wherein the anti-freezing passage is spaced a set interval downward from an upper end of the first cover portion.

12. The refrigerator according to claim 10, wherein the anti-freezing passage has a first end disposed at a central portion of the first cover portion, the anti-freezing passage extending from the first end to the cover edge portion.

13. The refrigerator according to claim 12, wherein the anti-freezing passage comprises:

a first anti-freezing passage recessed in the first cover portion; and a second anti-freezing passage extending from one end of the first cover portion toward the damper.

14. The refrigerator according to claim 13, wherein the second anti-freezing passage is located between an upper end of the cover edge portion and a lower end of the second cover portion.

15. The refrigerator according to claim 1, wherein a flow rate of the cold air discharged from the anti-freezing passage is less than about 1% of a flow rate of the cold air discharged by the fan.

16. A refrigerator comprising:

a first storage space;

a second storage space located at one side of the first storage space;

a passage duct assembly located behind the second storage space, the passage duct assembly having a cold air passage;

a fan assembly located behind the first storage space, the fan assembly having a fan configured to blow cold air;

a supply duct assembly configured to supply the cold air from the fan assembly to the passage duct assembly; and a passage opening/closing module configured to selectively block the cold air supplied to the supply duct assembly, the passage opening/closing module having:

a damper having:

a damper through-hole through which the cold air passes;

a damper door configured to open and close the damper through-hole;

a damper mounting guide portion encircling the damper door; and a motor configured to open and close the damper door; and a damper cover configured to surround at least a portion of the damper, the damper cover having an anti-freezing passage through which a portion of the cold air blown from the fan assembly is discharged to the supply duct assembly when the damper through-hole is closed, wherein at least a portion of the anti-freezing passage overlaps with the damper through-hole with respect to a horizontal direction, and wherein the anti-freezing passage comprises an inclined portion that is inclined downward toward one side of the damper cover.

17. The refrigerator according to claim 16, wherein the damper cover comprises a first cover portion, and wherein the anti-freezing passage is recessed inward from the first cover portion, the anti-freezing passage being spaced a set interval from the damper.

18. The refrigerator according to claim 17, wherein the anti-freezing passage has a first end located at a central portion of the first cover portion and a second end located at one side of the first cover portion.

19. The refrigerator according to claim 18, wherein the inclined portion of the anti-freezing passage is inclined downward toward the one side of the first cover portion.

20. The refrigerator according to claim 16, wherein the damper cover further comprises a first damper cover and a second damper cover, which are configured to surround a first side of the damper and a second side of the damper, respectively, wherein the damper door is configured to open in a direction toward the first damper cover, and wherein the anti-freezing passage is located in the first damper cover.

21. The refrigerator according to claim 18, wherein the anti-freezing passage has an area that gradually decreases toward the one side of the damper cover.

* * * * *